US005421760A

United States Patent [19]

Blaga

[11] Patent Number: 5,421,760

[45] Date of Patent: Jun. 6, 1995

[54] SELF INFLATABLE MINI-COLLAR LIFE PRESERVER

[76] Inventor: Alexandru Blaga, 249-Ocean Pkwy.-Apt. 5A, Brooklyn, N.Y. 11218

[21] Appl. No.: 257,513

[22] Filed: Jun. 9, 1994

[51] Int. Cl.[6] ..... B63C 9/08

[52] U.S. Cl. ..... 441/123

[58] Field of Search ..... 441/81, 88, 92, 95, 441/96, 97, 100, 108, 122, 123, 124

[56] References Cited

U.S. PATENT DOCUMENTS 4,960,483 10/1990 Switlik ..... 441/123

FOREIGN PATENT DOCUMENTS 2424848 1/1980 France ..... 441/123

*Primary Examiner*—Jesus D. Sotelo

[57] ABSTRACT

This invention concerns a new type of Mini-Collar which can be worn continuously around the neck, its very small, very light, not bulky, comfortable, and brought into use rapidly and very easily. The Collar is formed from two symmetrically almost identical, independent major elements. The invention provides for each major element to be independent and to include apparatus to deliver compressed air, to inflate an expansible envelope providing support for an individual in the water. The inflatable assembly of each independent element comprises essentially a frame shaped as a semicircle which is a container frame filled with compressed air. Cooperation between the two elements provides that each one forms at one end, half of a hinge which secured to each other will form a solid coupling element. At the other end of the frame container, each element has a terminal head equipped with apparatus to lock the Mini-Collar around the neck and in the event of an emergency to deliver the compressed air from the frame container into the inflatable envelope. The inflatable assembly of both independent elements will be simultaneously activated by a control member, when the individual who carries the Mini-Collar will activate the control member.

7 Claims, 7 Drawing Sheets

SELF INFLATABLE MINI-COLLAR LIFE PRESERVER

BACKGROUND OF THE INVENTION

The present invention concerns an, "Inflatable Mini-Collar Life Preserver", to be worn continuously around the neck by any individual. The Mini-Collar is provided with means of expansible envelopes able to expand under the pressure of air released from a frame container in the event involving the danger of drowning.

Life preservers are known to last a long time under different types of construction and manner to be worn. It is a real challenge to try to build a new type of life preserver. Many of previous inventions all have various types of drawbacks such as poor construction,or too complicated,for example foreign or U.S.A., patents FR.-788,421, -U.S. Pat. Nos.,-2,766,466; -3,798,692; or 4,662,850, are life jackets which typically can be donned prior to the emergency situation, or at least prior to entering the water. In the event that the vest must be donned after the person is in the water the configuration of the vest becomes extremely cumbersome and complex, because many life vests include numerous belts and buckles which may also have to be unfastened prior to putting on the vest.

Also the inflation devices must be operated and especially if the person becomes unconscious, the vest actually creates an unsafe and hazardous condition.

Moreover the lifebelt like DE.No.-135,858;-FR.Nos.-10,858;- 32,195;- 24,854;- or U.S. Pat. Nos.-3,119,132;-4,701,145;-5,178,569 are different type of life preserver apparatus which as prior patents have a serious drawbacks because the flotation volume develops at the level of the waist of the wearer which is below the center of gravity of the wearer. Such apparatus is incapable of keeping the person stable on the surface of the water while assuring that the person's head remains above the surface.

Furthermore the Collar life preservers types of apparatus has serious drawbacks such as- GB.No.-2,130,972, which discloses a harness which also enfolds the neck and comprises one single chamber and one single container of gas under pressure. Besides being hard to put on in the event of panic or an emergency, it includes only one chamber and one container of gas. Moreover, the actuation system provides for the operation of cords or ropes, which are not only dangerous in the event of panic but are also hard to locate and actuate. U.S. Pat. No.-3,321,785, discloses a collar with two watertight containers which can be inflated by actuating two containers of gas under pressure. This disclosure includes a collar which is hard to wear and has protruding parts that are easily broken and dangerous for the user. Moreover, the means to actuate the containers of gas under pressure are unreliable and hard to operate. U.S. Pat. No. 3,633,230, discloses a collar with a watertight container which can be inflated by actuating a container of gas under pressure. This teaching entails, first of all, less safety since there is only one watertight container and one container of gas; moreover, the system for actuation of the gas container is not workable, the system for putting on and securing the collar is net safe and is hard to use in the event of panic, and besides, the structure of the collar is fragile and readily breakable.

Furthermore, all the above mentioned apparatus are too big to be carried on continuously and all are bulky, irksome to wear, and very ugly.

With the above and other objects in view, I present a new type of Mini-Collar life preserver which is as constructed very simple, very light, very small, that when it is taken off you can put it in your pocket, moreover, is very comfortable and could be worn continuously, very easy to be constructed, inexpensive, and extremely important very, very easy to be operated in the event of panic or an emergency.

SUMMARY OF THE INVENTION

This invention relates to life preserver devices and particularly to that type of life preservers which are designed to be worn around the neck of a person continuously. One object of the invention is to generally improve upon devices of this class by the provision of a comparatively more simple, durable efficient and reliable in operation,life preserver provided with means whereby it may be quickly and easily fastened around the neck of a person or removed therefrom,and one which will be well adapted to the purpose for which it is designed.

The present invention consist of two almost identical independent major elements as seen in FIG. 4. Number 21, FIG. 4, represent half of the Mini-Collar. Every half major element of the collar has the same number and type of parts. Each half independent element has a frame container 22 filled with air under pressure. Each frame container has at one end half of a hinge 28 together forming a solid coupling element, and at the other end has a terminal head 23, which together forms a second coupling which will lock the Mini-Collar and at the same time they will form a lodgement 96, for control member 25. Number 25 is a control member which when activated will press the needle 27 of valve 26 to release the compressed air from frame container 22 and via passage 34 duct 33 perforation holes 38 will inflate the envelope 24. Each expansible envelope 24 will cooperate with its respective frame container 22. The invention will be further described with reference to the accompanying drawings.

BRIEF DESCRIPTION OF THE DRAWINGS

FIG. 12A.—Is the same as FIG. 12, only that here the vacuum from inside of control member 25 is broken and the spring 82 expands and at the same time will expand the volume of the control member 25.

FIG. 13A.—Is the same sectional view as FIG. 13, only here as in FIG. 12' the vacuum has been broken and in addition you can see the small pipe 83, whereby the air or water will pass into the control member to allow the spring 82 to expand.

DETAILED DESCRIPTION OF THE INVENTION

Figure 1:
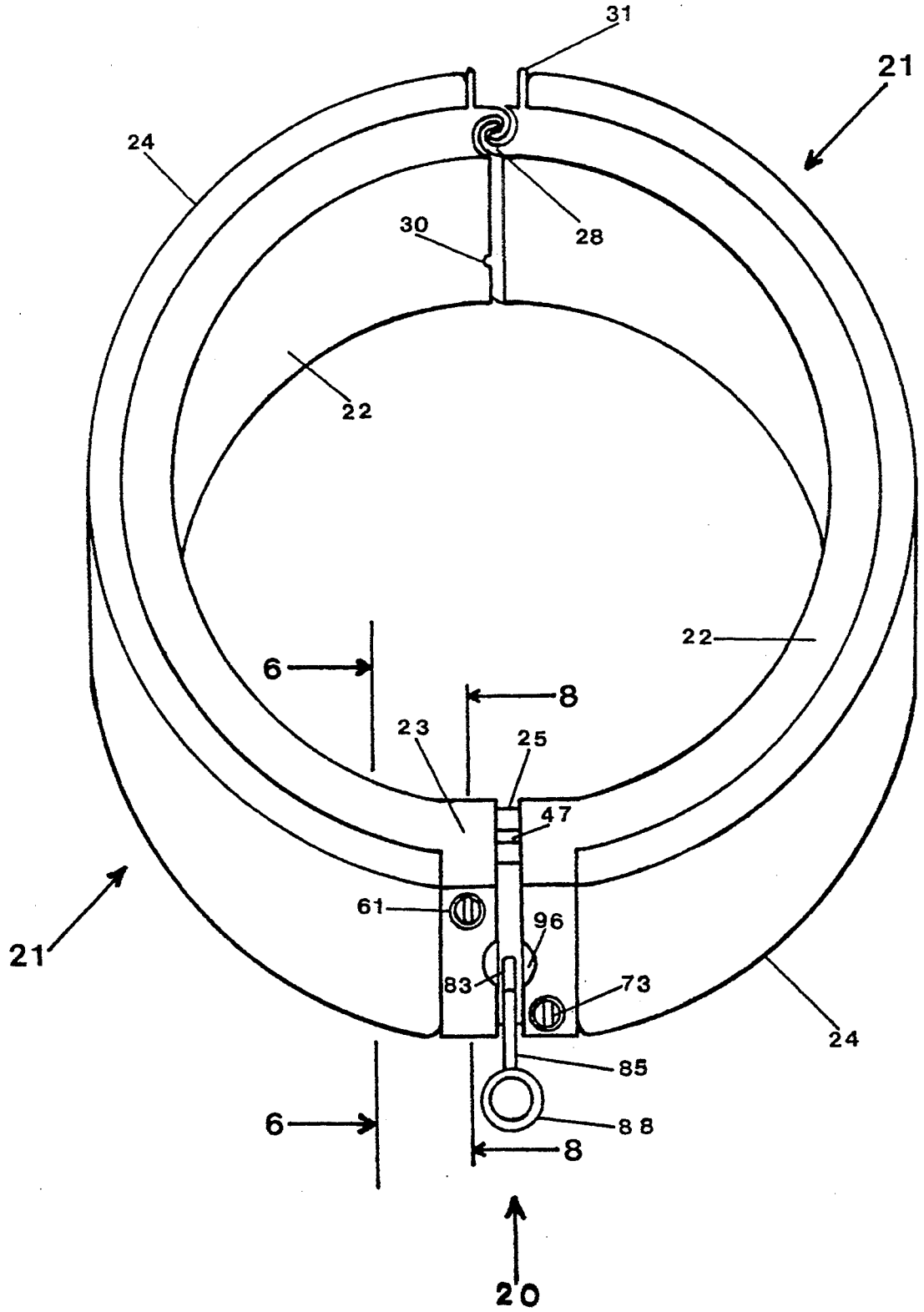
FIG. 1.—Is a perspective view of Mini-Collar life preserver in its normal size. Could be reduced to; 1" h×½" w.
Figure 2:
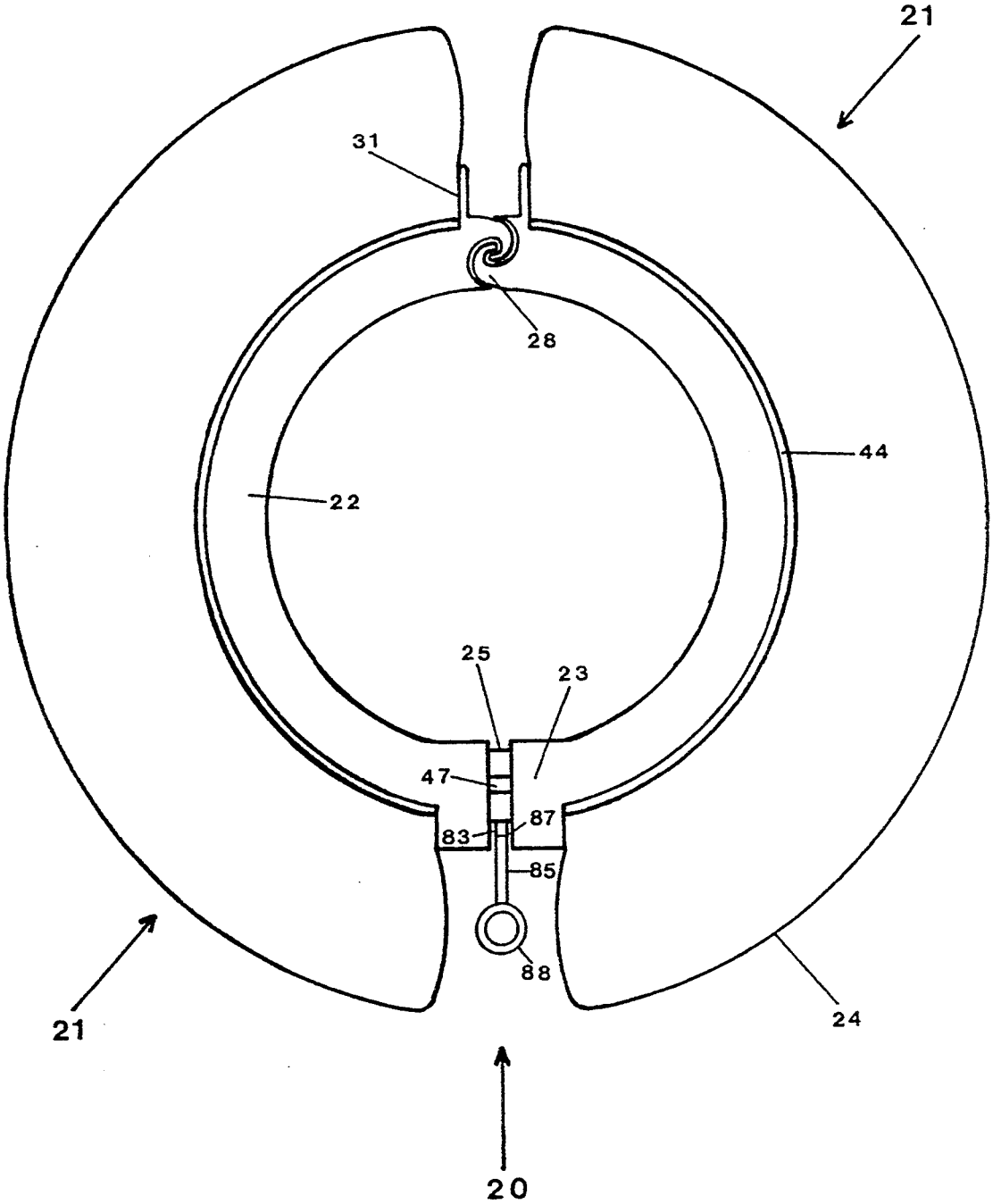
FIG. 2.—Is a view of Mini-Collar,taken from above with the inflatable envelopes in open position, or only partially inflated but not in normal size.

The invention of -"SELF INFLATABLE MINI-COLLAR LIFE PRESERVER" concerns a new type of Mini-Collar life preserver which consist of only two symmetrically almost identical elements 21, plus one single element 25 to cooperate with the pair 21 to form the Mini-Collar 20 as is presented in FIG. 1 or FIG. 2.

Because of the similarity of the parts, in the following exposition of the invention the same numbers will be used to designate like parts, also do not fill the drawing with numbers, any number in one of the independent elements is the same number and same part in the second half of element, except for control member 25. As it was mentioned before both independent half elements of the Mini-Collar have the same number and the same type of parts. Every half independent element 21 has a frame container 22 which is filled with compressed air and is the base of the Mini-Collar. The container can be made of any plastic, aluminum, fiber glass, or any light but strong material. The frame at the top side has the edge 50 rounded to be more comfortable in contact with the neck. One end of each frame container extends into a half of a hinge 28 which could be secured to each other in stable manner to form a coupling element. At the other side of frame container 22 we have the terminal head 23 of the container frame. The half hinges 28 and terminal head 23 are common parts of the frame container 22 all made as one piece. The half hinge 28 has at its front in the top of the curved part a pin 29 which will slide in slot 30 at the other half of the hinge, cooperating together and avoiding any movement of the hinge up or down.

Figure 5:
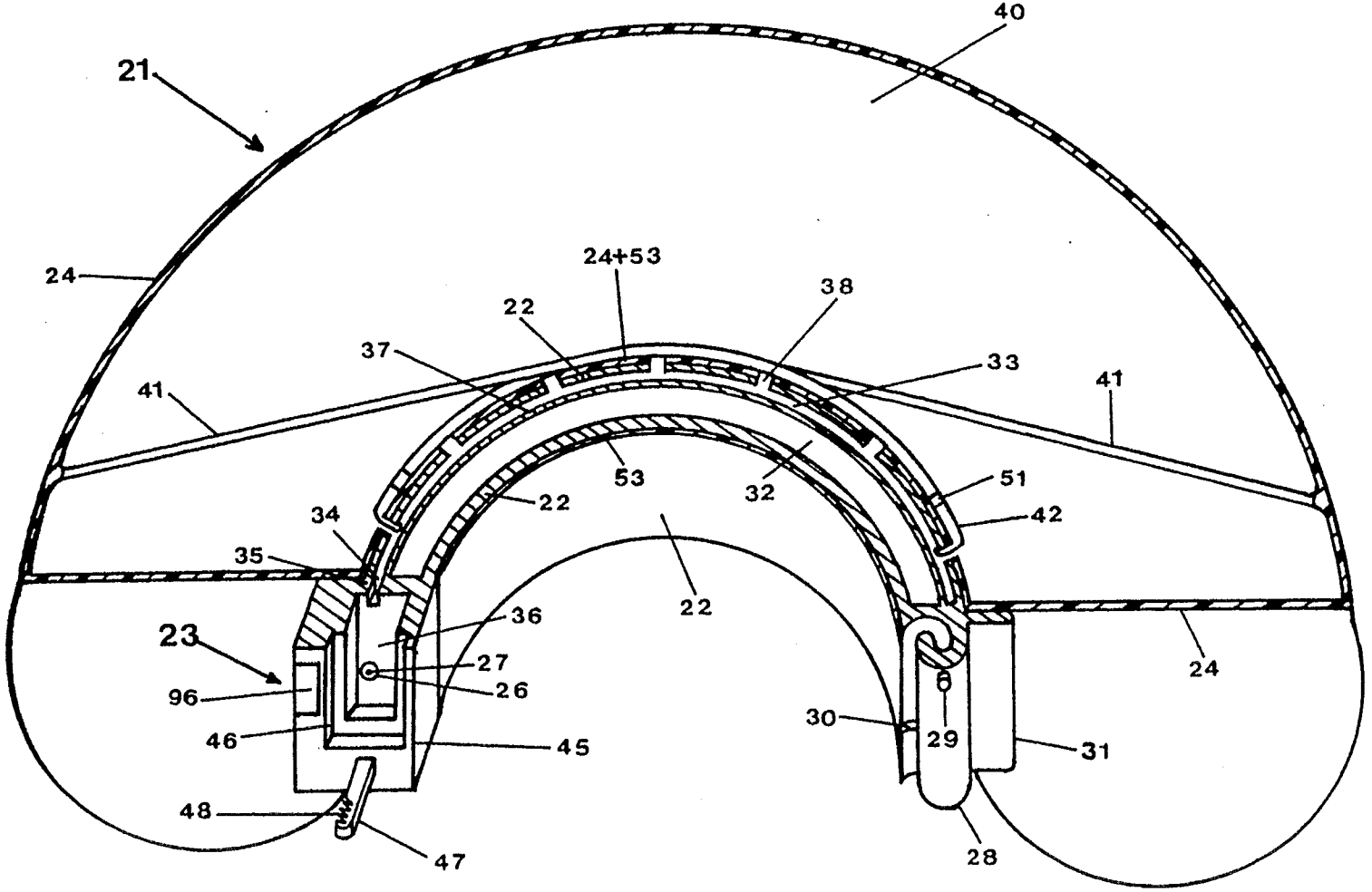
FIG. 5.—Is a cross sectional view of half of the Mini-Collar taken about line 5—5 in FIG. 4.
Figure 6:
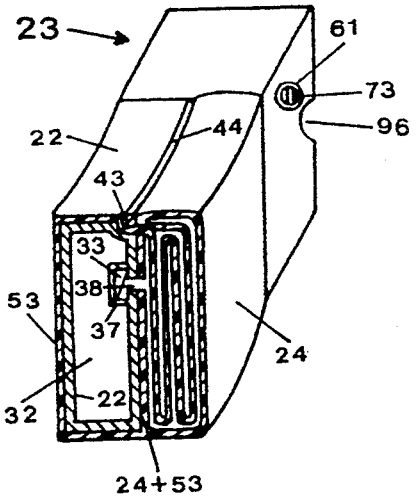
FIG. 6.—Is a fragmentary cross sectional view of the invention taken about line 6—6, in FIG. 1, without control member 25.

At the exterior part of the hinge we have a flange 31, which together with the abutment side of head 23 of the frame, form a lodgement for expansible envelope 24 when it is folded up or in a closed position. As seen in FIG. 5, the frame container 22 has a chamber 32 which, as noted before, is filled with compressed air.

Figure 7:
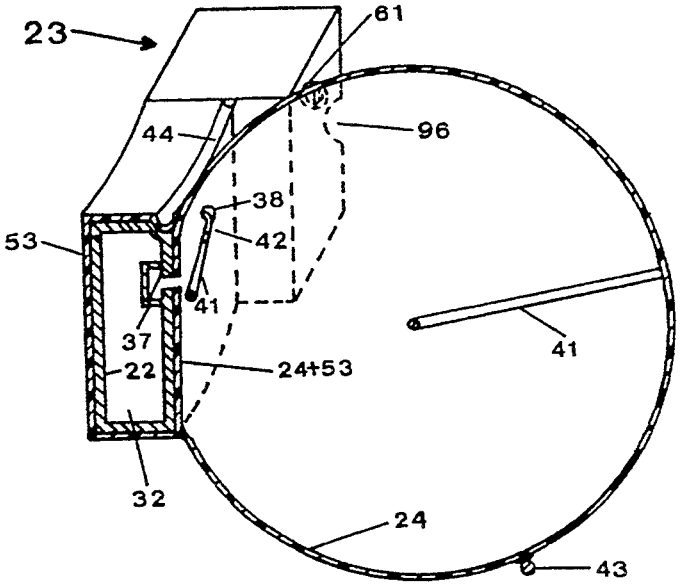
FIG. 7.—Is same as FIG. 6, only the inflatable envelope 24 is in its open position or partly inflated.

Inside of chamber 32 of frame 22 there is a second small chamber 33 which with the passage 34, is passing through the wall 35 in the head chamber 36. In FIGS. 5 and 7, it can be seen that the wall 37 together with one of the chamber 32 interior walls, form a duct with the chamber 33 inside of this duct.

Figure 3:
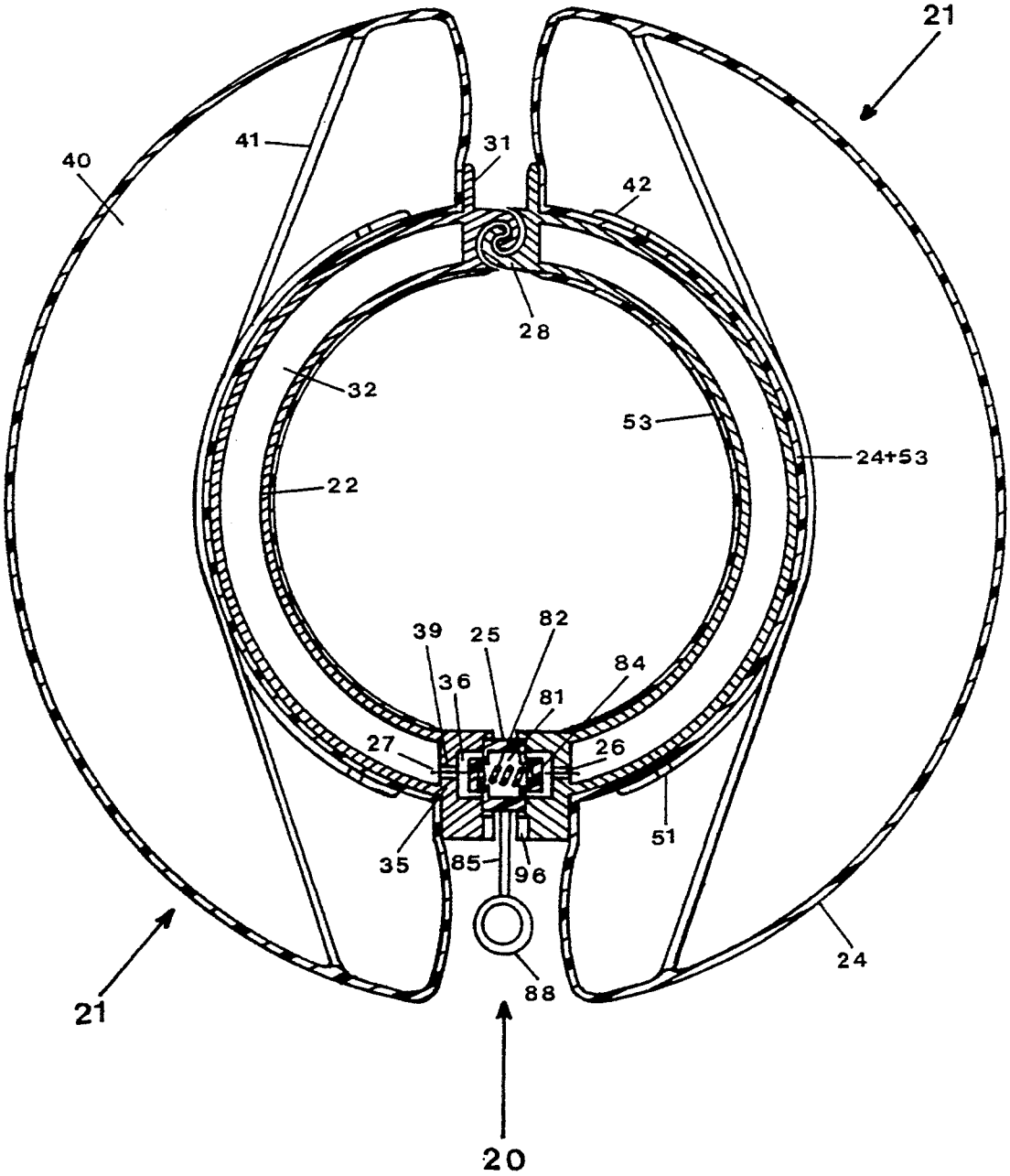
FIG. 3.—Is a horizontal longitudinal cross sectional view of the invention taken in FIG. 2.
Figure 4:
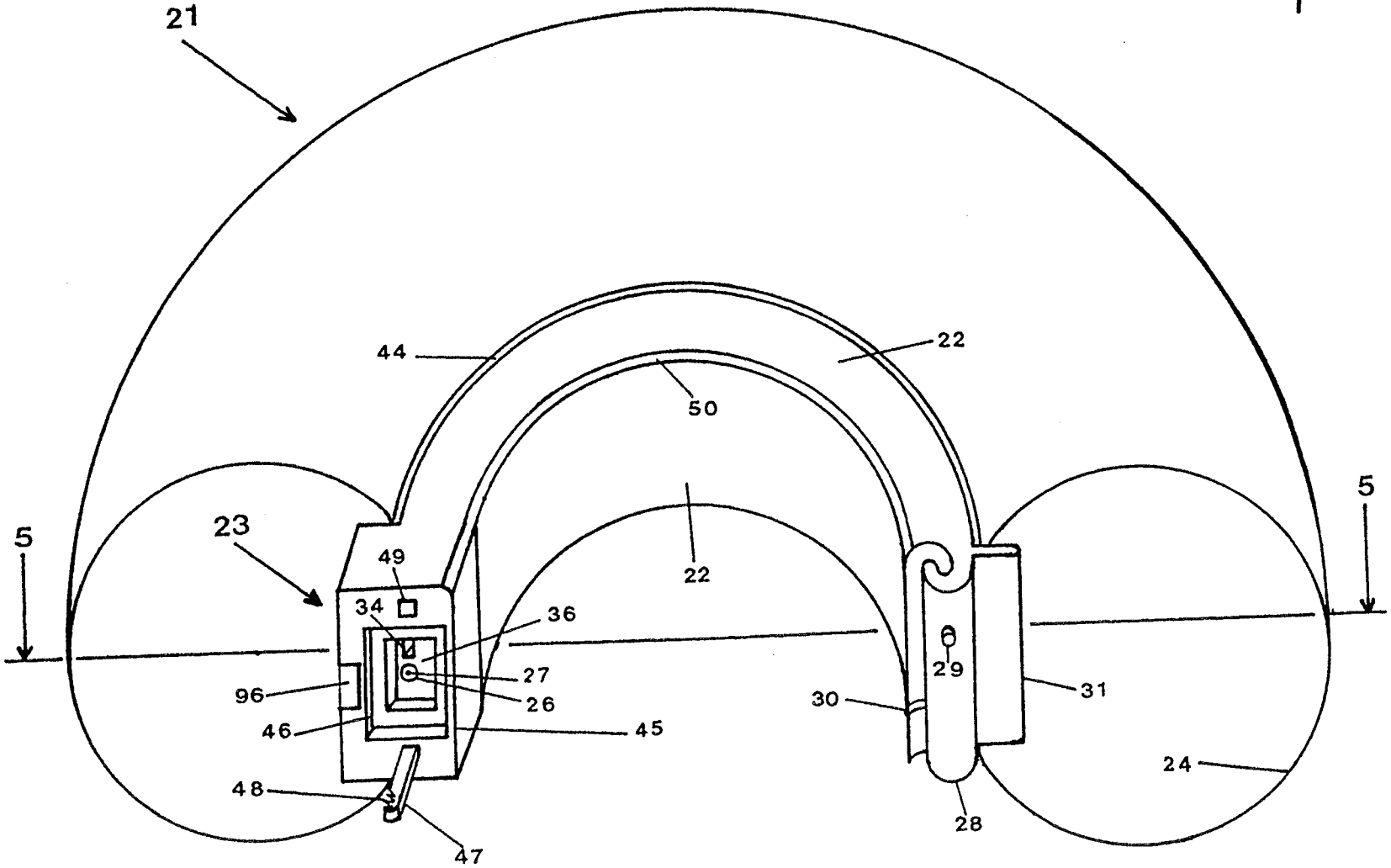
FIG. 4.—Is a perspective side view of half of the Mini-Collar.

The role of this duct is to deliver the compressed air released from frame container chamber 32 and direct it through perforations 38 to inflate the expansible envelope 24. In FIG. 3, it can be seen that the wall 35, which separate the chamber 32 from chamber 36, has a bore 39 which passes through the wall 35 and advantageously comprises a simple non-return one way air valve 26 which is not illustrated. When the control member 25 is actuated the control member will press the pin 27 of the valve 26 releasing the compressed air from chamber 32 in chamber 36 and from there via passage 34 into duct 33 and through the perforations 38 in envelope chamber 40 inflating the expansible envelope 24. The perforations 38 pass through the wall of frame container 22 and through the wall of inflatable envelope 24.

The inflatable envelope 24 is attached to the frame container 22 at the exterior side of the frame by being glued or molded together with the rubber surface 53, which is molded over the frame container enveloping the frame. The inflatable envelope 24 is made of a very good rubber material with a large coefficient of elasticity. Inside of envelope 24, there are two ropes 41, which are made of the same rubber material. One end of each ropes is molded or glued to the interior wall of the envelope at about 25 degrees from the end of the envelope. One rope is glued at one end, the second rope at the other end of the envelope at opposite direction but at the same 25 degree of the end of the envelope. The other end of the ropes 41 are equipped with a simple hook 42 which will be fixed in hole 38 by stretching the rope. After the collar has been used, when we start to release the air from the envelope to fold it back in the closed position, the two ropes 41 will act as a spring by pulling the ends of the envelope slowly, little by little as the air is released, inside of the envelope till about 45 degrees of the semicircle center of the frame container. At this point the envelope can be folded up in its lodgement. The envelope has attached in the exterior part of its body a rib 43 made of the same material rubber, which can be molded at the same time with the envelope as part of its body. This rib is attached only 45 degrees at right and 45 degrees at left of the central point of 90 degrees of the center of the envelope and frame container. After the ends of the envelope are pulled in by the ropes 41, the envelope will be folded up and the rib 43 will be pressed inside of slot 44 where it will fit-tight holding up the envelope in a closed position. The rib 43 is placed at the required distance over the envelope body to fit exactly in slot 44 after the last folding of the envelope is done. Still following FIG. 5, the head 23 at one side has a wall 35 and at the other side is defined by the frame 45.

Inside of frame 45 we have cut out at 90 degree a lodger 46 where the control member 25 will fit exactly being closed between the heads. At the bottom, as part of the head 23 there is an anchorage tongue 47 equipped with teeth 48 at one side, which cooperates with a lodgement 49 from the other half element as can be seen in FIGS. 8 and 9 where it will meet with tooth 60 to cooperate together keeping the collar 20 in closed position.

Figure 8:
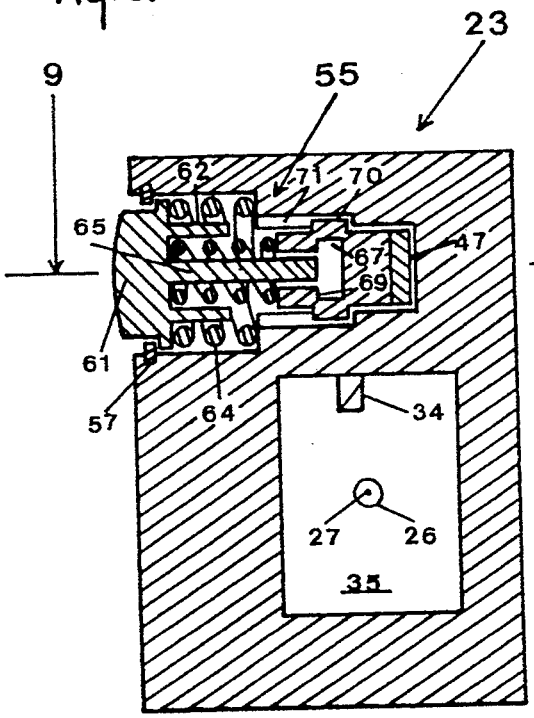
FIG. 8.—Is a fragmentary cross sectional view of the invention and is taken about line 8—8, in FIG. 1.
Figure 9:
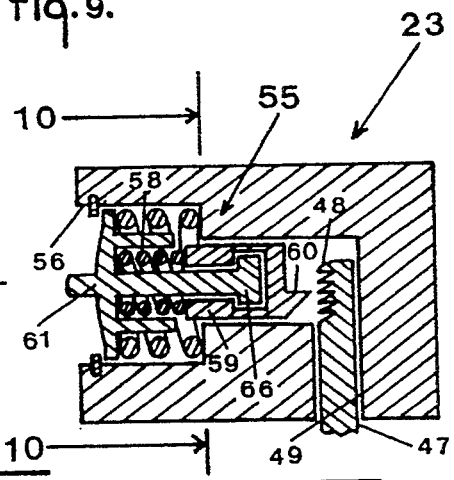
FIG. 9.—Is a fragmentary cross sectional view of the invention and is taken about line 9—9, in FIG. 8.
Figure 10:
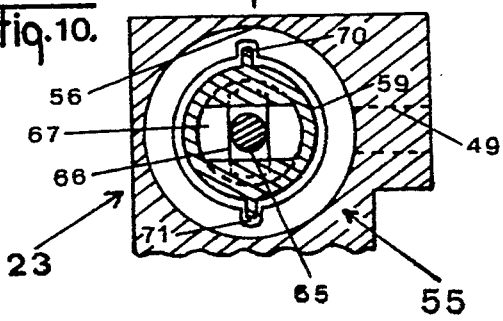
FIG. 10.—Is a fragmentary cross sectional view of the invention and is taken about line 10—10, in FIG. 9.

The embodiment assembly 55, shown in FIGS. 8, 9, and 10, comprises a simple double action push-pull button,which has two positions: ON and OFF. The whole embodiment of the button assembly is kept inside of bore 56 by safety ring 57. In FIG. 8, the button is in ON position where it will be kept at all times by the spring 58, which is pressing down the sliding piece 59 which at the other end has a tooth 60 which is cooperating with teeth 48 of the anchorage tongue 47 to keep the collar 20 closed.

The collar 20 will open by setting the button 55 in OFF position as follows: The head handle 61 of the button assembly has a skirt 62 which separate the spring 58 from spring 64. The same handle 61, in the center has an arm 65, which ends in the shape of a "T" with a head 66. By pressing the handle 61 inside of the inner casing formed by bore 56 it will press down both spring 58 and 64.

At the same time the head 66 of the "T" arm 65 will slide inside of inner lodgement 67 which is cut inside of sliding piece 59.

Figure 11:
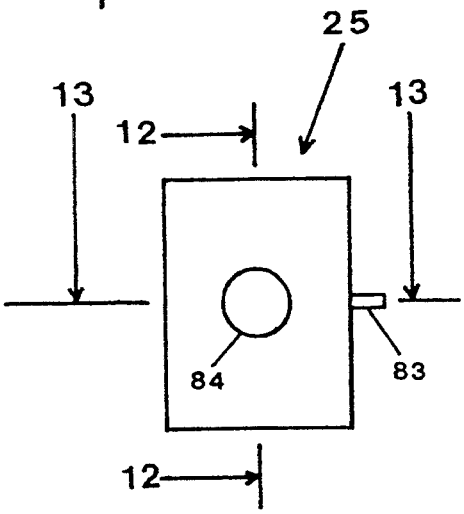
FIG. 11.—Is a view of control member 25.
Figure 12:
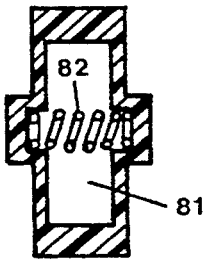
FIG. 12.—Is a vertical longitudinal cross sectional view of control member 25 taken about line 12—12, in FIG. 11.
Figure 12:
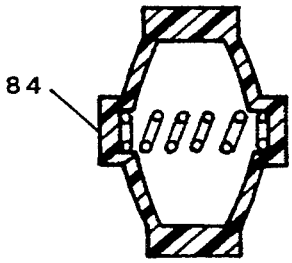
Figure 13:
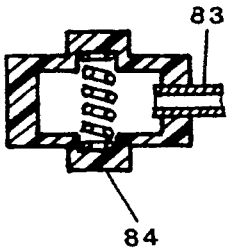
FIG. 13.—Is a horizontal cross sectional view of control member 25, taken about line 13—13, in FIG. 11.

At the time the bottom of lodgement 67 is reached, pressure is maintained as the handle 61 is turned around at 90 degrees in the horizontal position. At this point by releasing the pressure the button 61 will return to its initial position, being pushed back by the spring 64. But at the same time when we turn the button handle 61, the head 66 of "T" arm 65 is turning and sliding behind the shoulder 69 and engaging the sliding piece 59. When we release the button 61, by being pushed out by the spring 64, the engaged parts 66 of the piece arm 65 and the sliding piece 59 will pull out the sliding piece 59 by sliding up and will desengage tooth 60 from teeth 48 allowing to pull out the anchorage tongue 47 and open the collar 20. FIGS. 8 and 10 show that the sliding piece 59 at the outer periphery of its body has two small wings 70 which are guided axially by the two slots 71 which are cut in bore 56 inner walls. The wings 70 will not let the sliding piece to turn around. The translational movement of piece 59 left and right is only about three millimeters, only to desengage tooth 60 from teeth 48. As we continue our description, in FIG. 11 we have a control member 25, which is made of rubber. As we can see in FIG. 3 or in FIG. 12, inside of the control member is a chamber 81, which when the control member 25 is in its inactive position the chamber 81 is in vacuum, keeping the walls very close together as seen in FIG. 13, and at the same time the walls will keep tight the spring 82. When the vacuum is broken, the spring 82 will expand pushing the walls away expanding the volume of the control member.

In both lateral sides of control member 25 where the spring 82 is held but in the exterior of the control member we have two protuberances 84 which when the spring expands pushing the walls away, these two protuberances 84 will act as a push button and simultaneously will press the pin 27 of the non-return valve 26 releasing the compressed air from chamber 32 which will inflate the expansible envelope 24. Another part with which the control member is equipped is a very thin pipe 83 which is made of steel and whereby the air or water will be sucked inside of the chamber 81 when the vacuum is broken by activation of the control member 25. In FIG. 13, we can see that the thin pipe 83 is passing through the wall of the control member inside of chamber 81 and extends out of the control member about one quarter of one inch.

Figure 15:
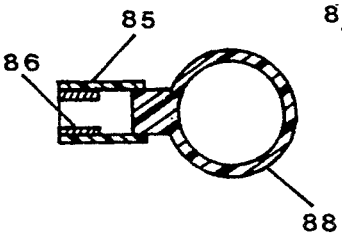
FIG. 15.—Is a vertical cross sectional view of the first type of closure 84 taken in FIG. 14.
Figure 14:
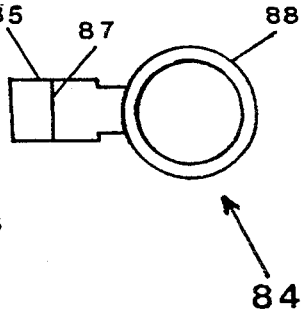
FIG. 14.—Is a type of closure for control member 25. This is a first type of closure number 84.
Figure 14:
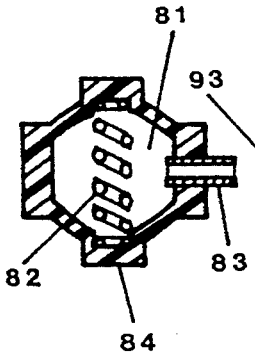

This quarter of one inch which is left out, could be equipped with threads or it can be only a plane pipe as will be seen in our further description. Regarding the plugging of the pipe 83 of the control member 25 necessary to keep the control member in vacuum, we have two types of plugs. In FIG. 14 and FIG. 15, we have a first type of plug 84 which is made from a piece of plastic tube 85 which at one end has glued inside thereof a threaded piece of pipe 86 which will be screwed up to the pipe 83 of the control member 25. At the other end of the plastic pipe 85 we connect the vacuum pump to extract the air from the control member.

When the control member is in vacuum we seal the plastic tube 85 at the point shown by the line 87. Once the tube is sealed at the end, we glue the handle 88. The handle acts as a handle and as a plug as we see in FIGS.14 and 15. The piece of plastic tube 85 could be glued straight to the control member pipe 83 when we use a plain type of pipe 83, not with thread. This control member with this type of plug as 84 can be used by anybody including children which can control the Mini-Collar. This type of plug can be used by children big enough that after being in the water and being in distress are able to catch the handle 88 and to tear of the plastic tube 85 to allow the water and air to enter in chamber 81 to activate the control member which will activate the collar to inflate the expansible envelope and rescue the child.

Figure 17:
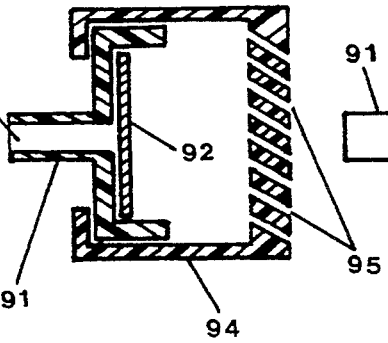
FIG. 17.—Is a vertical cross sectional view of the second type of closure 90 taken in FIG. 16.
Figure 16:
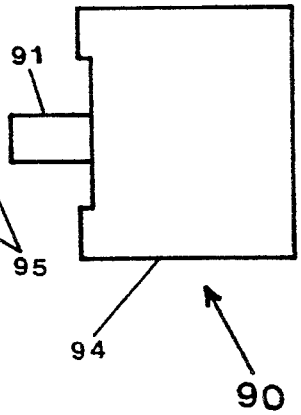
FIG. 16.—Is a side view of a second type of closure for control member 25 number 90.

The second type of plug as plug 90 which can be seen in FIGS. 16 and 17, is made special for small children which can not control the control member. For example, if the children are playing around the water, such as a swimming pool, river, ocean, etc., and by accident fall in the water, this device which acts as a plug 90, will activate itself and the control member, as will be seen in the further description.

This plug device 90 is made of three parts;

1.—Number 94, in FIGS. 16 and 17 is a shell made of very thin plate of aluminum or plastic and has a threaded neck 91 that can be screwed up to the thin pipe 83 of the control member 25.

2.—Number 92 in FIG. 17 is a lamella of iodine with the thickness all ready calculated which is glued inside of piece 91 by closing the neck passage 93 to not let the air pass through into the control member chamber 81 maintaining the control member 25 in vacuum.

3.—Number 94 in FIGS. 16 and 17 is a cover which snaps over piece 91 holding together to not let the water touch the lamella of iodine 92. But the cover 94 in the front has cut through its wall small oblique channels 95 which will not let the water which is thrown or sprinkled around when the children are playng out of the water to enter inside of the device 90. But if by accident the user falls in the water, this oblique small channels will allow the water to pass through and by dissolving or only softening the iodine lamella 92, the vacuum from inside the control member will suck the lamella with the water and air, and will activate the control member which will activate the collar and rescue the child. These two types of plug closures for control member 25, but specially the second type 90, will fit in lodgement 96 which is formed by the heads 23 of collar 20 without being tight or placing pressure in them. Thus there has been shown and discribed a novel, -Self Inflatable Mini-Collar Life Preserver, -which fulfills all the objects and advantages sought therefor. Many changes modifications and other uses and applications of the subject invention will, however, become apparent to those skilled in the art after considering this specification together with the accompanying drawings and claims.

All such changes, modifications, variations and other uses and applications which do not depart from the spirit and scope of the invention are deemed to be covered by the invention which is limited by the claims which follow.

What is claimed is:

1. A self inflatable collar life preserver, for use in preventing drowning, which can be worn continuously by an individual around the neck, comprising means to deliver compressed air to expansible envelope means having two substantially identical major independent elements which are completely separable from each other at a reciprocal joint, and wherein the collar is equipped with a control-member adapted to assure the simultaneous inflation of said expansible envelope means of both independent elements, and wherein each independent element has a frame container equipped with at least one chamber filled with compressed air, and wherein each frame container is equipped with one expansible envelope which includes at least one chamber, and where the expansible envelope is attached at the exterior side of the frame container, and wherein each frame container at one end extends into a half of a hinge comprising means which will cooperate together with means of the second half of the hinge from the second independent element to form a coupling element for the collar, and wherein the frame container at the other end has a terminal head equipped with an assembly of a double-action push-pull button which will lock or unlock the collar, and wherein each independent element has the same number and same type of parts and wherein the terminal head and the half of the hinge of each element forms a common part of the frame container and wherein each frame container at the exterior at one side of its height has cut a slot lengthwise of its body, and, wherein each half of the hinge is equipped at the exterior side with a flange which together with the abutment on the side of the terminal head of the frame container form a lodgement for expansible envelope which when is not inflated is folded up in this lodgement in a closed position, and wherein each individual element has molded over its frame container a rubber surface by enveloping the frame, and wherein each expansible envelope is molded at the same time with the rubber surface which is molded over the frame.

2. A self inflatable collar life preserver claimed in claim 1, wherein each independent element comprises a frame container which has the terminal head of each container equipped with connecting means comprising an anchorage tongue and a small lodgement which are installed such that each anchorage tongue from one head will cooperate with the small lodgement of the head of the second frame container as a male and female connection and will be assisted by the assembly of a double action push-pull button on each head which will lock and unlock the collar, and, wherein the head has a common wall which separates the head from the frame container chamber, and, wherein the head common wall has a bore passing through the wall into the inside of the frame container chamber, and wherein the bore advantageously comprises a simple non-return one way air valve which will be used to fill up the frame container chamber with compressed air or to release the air from the frame container chamber, and wherein the same common wall has a slat passage through the wall into the chamber of the frame container, and wherein the frame container chamber is equipped with means comprising a duct which is installed inside of the chamber lengthwise from the common wall to the half hinge being connected with the slat passage of the common wall, and wherein the duct has a plurality of holes which connect the duct with the expansible envelope chamber.

3. A self inflatable collar life preserver, according to claim 1, wherein each expansible envelope is equipped with means comprising two ropes which are made from the same material as the envelope is, and wherein the two ropes have one end glued at one end of the envelope in opposite direction and the other end is equipped with a simple hook which is fixed on a duct hole, and wherein when the expansible envelopes are not inflated the two ropes act as a spring pulling the ends of the envelope inside of the envelope so the envelope can be folded up in its lodgement, and wherein each expansible envelope has attached in the exterior side of its body a rib which is made from the same material molded at the same time with the envelope as part of its body, and wherein, when the envelope is folded up, the rib will be pressed inside of the exterior slat of the frame container holding the envelope in a closed position.

4. A self inflatable collar life preserver, according to claim 1, where the collar is equipped with a control member made of rubber material, and wherein the control-member includes at least one chamber, and wherein the control-member at both lateral exterior sides has two protuberances in the form of two bottons, and wherein inside of the control-member chamber there is a spring which is fixed in contact with the two protuberances inside of the chamber, and wherein the control-member is equipped with a very thin pipe which can be equipped with thread or can be a plane pipe which is made from steel and where by air will be extracted from the control-member chamber, keeping the control-member in the vacuum, which will keep its walls closed together and the wall will keep the spring tight, and means to maintain the vacuum in the chamber.

5. A self inflatable collar life preserver, according to claim 4, wherein the means to maintain the vacuum comprises a plug made from a piece of plastic tube which on one end is be attached to the thin pipe of the control-member and at the other end is glued a handle which will plug the plastic tube, and wherein the collar equipped with this plug can be used by anybody including chilren big enough that after being in the water and being in distress are able to catch and pull the handle to tear of the plastic tube to allow the water and air to enter inside of control-member chamber wherein when the vacuum is broken because water and air pass through inside of the control member chamber, at this point the spring inside of the control member will expand pushing the wall away and at the same time the two protuberances will act as a push button and simultaneously will press the pins of the non-return one-way air valve of both heads of the frame container releasing the compressed air from the frame container chamber which will pass through the wall slat passage and via the duct through the holes of the duct inside the envelope chamber inflating the expansible envelope and rescuing the user.

6. A self inflatable collar life preserver, according to claim 4, wherein the means to maintain the vacuum comprises a plug made of plastic material and has its own body as a shell with a interior chamber and the body has a neck which is attached to the thin pipe of the control-member, and wherein the neck has a passage which connects the shell chamber with the control-member chamber, and wherein the shell chamber is equipped with a lamella of iodine which is glued inside of the shell chamber over the neck passage to not let the air pass through into the control-member chamber maintaining the control-member in the vacuum, and wherein the chamber shell has a cover which snaps over the shell body holding together, and wherein the cover in the front has cut through its wall small oblique channels which will not let the water which is thrown or sprinkled around to enter inside of the shell chamber, and wherein when the user falls in the water, the oblique small channels will alow the water to pass through inside of the shell chamber and by dissolving or only softening the lamella of iodine,the vacuum from the inside of the control-member will suck the lamella with the water and air inside of the control-member chamber, and wherein when the vacuum is broken because the water and air pass through inside of the control-member chamber, at this point the spring from inside of the control-member will expand pushing the walls away and at the same time the two protuberance will act as a push button and simultaneously will press the pins of the non-return one-way air valve of both heads of the frame container releasing the compressed air from the frame container chamber which will pass through the wall slat passage and via the duct through the holes of the duct inside of the envelope chamber inflating the expansible envelope and rescuing the user.

7. A self inflatable collar life preserver, which is formed from two substantially identical major independent elements which could be completely separated at a reciprocal joint and wherein each major independent element comprises a frame container filled with compressed air and each frame container has been equipped at one end with a half of a hinge which comprises means to form with the second half of a hinge a solid coupling element for the collar and wherein at the other end, the frame container is equipped with means as an assembly of a push-pull button which will cooperate with an anchorage tongue and a small lodgement, which are part of means to lock or unlock the collar, and, wherein each frame container is equipped with an expansible envelope which is attached at the exterior side of the frame, and wherein the collar is equipped with an control-member which when activated will activate the collar by transfering the compressed air from the frame container chamber into the expansible envelope and rescue the person wearing the collar.

* * * * *